United States Patent [19]

Hesterman

[11] Patent Number: 4,922,227

[45] Date of Patent: May 1, 1990

[54] TOUCH-CONTROLLED SWITCH AND ALARM SYSTEM

[76] Inventor: Bryce L. Hesterman, P.O. Box 472, Orem, Utah 84059

[21] Appl. No.: 301,871

[22] Filed: Jan. 24, 1989

[51] Int. Cl.[5] ..... G08B 23/00; H01H 35/00

[52] U.S. Cl. ..... 340/527; 340/562; 200/DIG. 2; 307/116; 307/308; 328/5

[58] Field of Search ..... 340/527, 528, 541, 561, 340/562, 565, 563; 200/DIG. 1, DIG. 2; 307/116, 308; 328/5

[56] References Cited

U.S. PATENT DOCUMENTS

| | | | |
|---|---|---|---|
| 3,691,549 | 9/1972 | Wilson | 340/527 |
| 3,978,478 | 8/1976 | Schmitz | 340/528 |
| 4,037,221 | 7/1977 | Alexander | 340/562 |
| 4,081,700 | 3/1978 | Hamilton, II | 307/308 |
| 4,287,513 | 9/1981 | Lam et al. | 340/562 |
| 4,295,132 | 10/1981 | Burney et al. | 340/562 |
| 4,550,310 | 10/1985 | Yamaguchi et al. | 340/365 C |
| 4,668,876 | 5/1987 | Skarman | 307/116 |
| 4,668,877 | 5/1987 | Kunen | 307/116 |
| 4,831,279 | 5/1989 | Ingraham | 340/562 |

OTHER PUBLICATIONS

Bill Daniels Co., Inc., Bill Daniels Illustrated Trade References, Jan. 1987/87 Security, Anti-Terrorism and Loss Prevention Equipment and Devices Buyers Guide, vol. 1, pp. S-1, S-1056.

*Primary Examiner*—Donnie L. Crosland

[57] ABSTRACT

A touch-controlled switch and alarm system for protecting electrically conductive objects. The touch switch automatically adjusts itself within a few seconds to a wide range of ungrounded conductive objects, is not triggered by AC power line transients or failures, has a back-up battery for operation during power failures, and is automatically triggered if the power plug is disconnected. A unique underdamped automatic gain control circuit allows a simple unidirectional trigger to sense both increases and decreases of capacitance to ground. The alarm includes a lock switch for arming and disarming the alarm, and status indicators to show whether or not the system has been armed or triggered. The lock switch itself is protected by the alarm system because the lock switch has an electrically conductive body which is connected to the touch switch along with the protected objects.

4 Claims, 5 Drawing Sheets

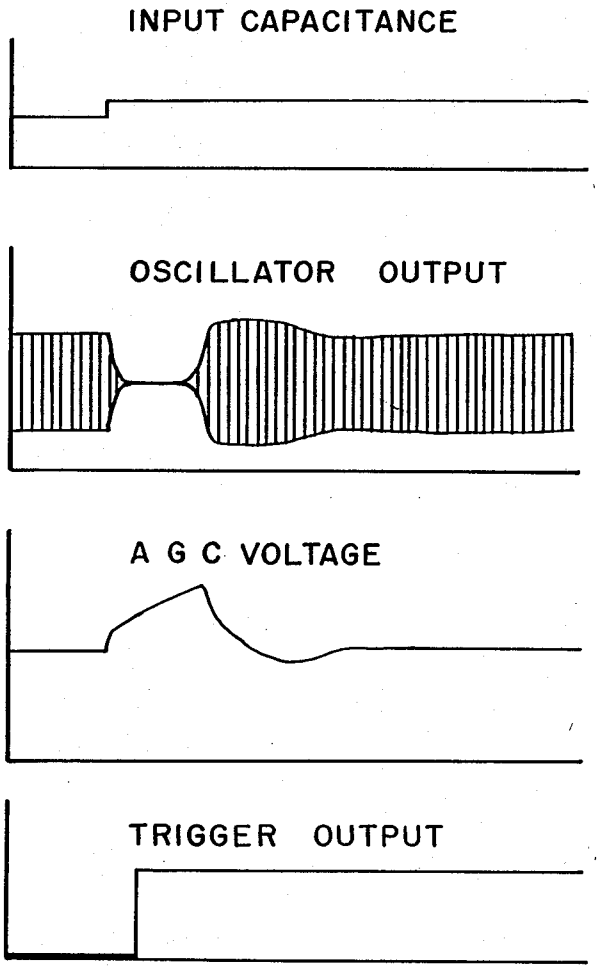
FIG. 5A FIG. 5B FIG. 5C FIG. 5D
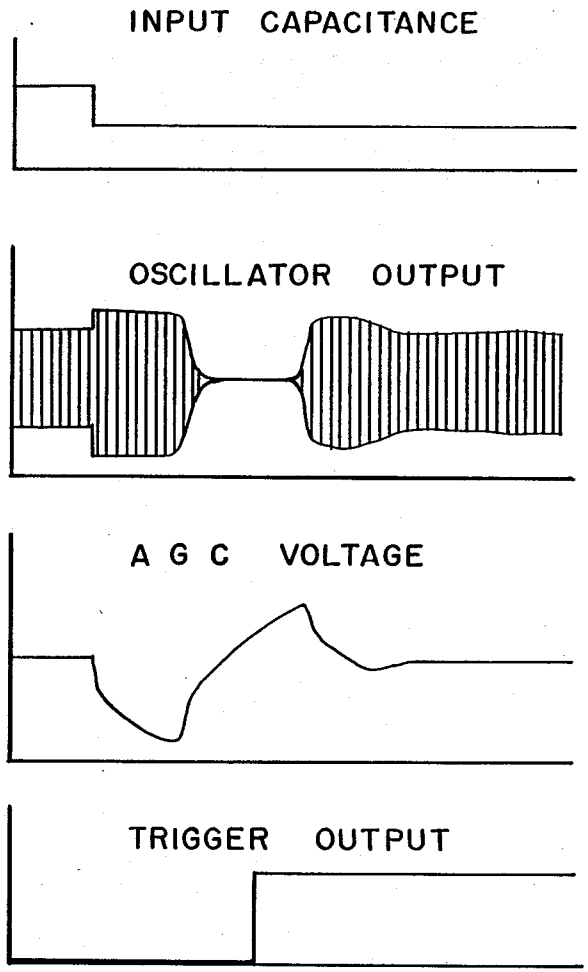
FIG. 5E FIG. 5F FIG. 5G FIG. 5H
Fig. 5

TOUCH-CONTROLLED SWITCH AND ALARM SYSTEM

BACKGROUND OF THE INVENTION

This invention relates to the field of touch-controlled switches and to the field of burglar alarms.

Prior art touch switches tend to have features that make them unsuitable for use in alarm systems, or they lack features necessary to make practical alarm systems.

Many touch-controlled circuits depend on AC power lines to provide the oscillating voltage required for capacitively operated switches. This dependency on AC power lines makes these circuits unsuitable for use in alarm systems which are required to operate during power failures.

Some touch-controlled switches create the required oscillating voltage with an internal oscillator, and thus could be adapted to operate from battery power during a power failure. Examples of touch switches using internal oscillators are U.S. Pat. Nos. 4,668,877 to Kunen (1987), and 4,668,876 to Skarman (1987). These switches have a significant drawback, however. They both have an oscillator which operates at a radio frequency, thus making them subject to governmental regulations regarding radio interference. Another common problem with oscillator-based switches is the need to manually adjust the parameters of components during the manufacturing process. U.S. Pat. No. 4,550,310 to Yamaguchi et al. (1985), for example, has tuned resonant circuits which must be precisely adjusted.

The trigger circuits of prior art touch switches are unidirectional, thus requiring two trigger circuits if both increases and decreases of capacitance are to be detected. U.S. Pat. No. 4,081,700, to Hamilton, II (1978), for example, suggests using two complementary trigger circuits.

Another feature desirable for alarm systems but unavailable in the prior art is a touch switch that is automatically triggered by disconnecting its power plug, but is not triggered by AC power fluctuations or failures.

SUMMARY OF THE INVENTION

The first object of this invention is to provide a touch switch useful in a variety of situations, but particularly suited for use in alarm systems. The second object is to provide an alarm system designed to protect electrically conductive objects.

The touch switch of the present invention, like several prior art touch switches, has its input conductor connected to the feedback path of an internal oscillator. The signal ground of the oscillator is coupled to earth ground, and the amplitude of the oscillations is stabilized by a slow automatic gain control (AGC) circuit. Increasing the capacitance between the input conductor and earth ground typically causes the amplitude of the oscillations to temporarily diminish, or possibly cease. Conversely, decreasing the input capacitance to ground causes the amplitude to temporarily increase. The touch switch is triggered when it detects changes in the amplitude of the oscillations.

A unique feature of the present invention is that the internal oscillator is controlled by an underdamped AGC circuit. If the input capacitance is suddenly increased, the oscillations momentarily diminish or cease, but due to the underdamped AGC, the oscillator output overshoots its equilibrium value before finally stabilizing. Decreasing the input capacitance has a similar effect; the oscillator output momentarily increases, but then the AGC causes the oscillations to momentarily diminish or cease before they stabilize. Because both increases and decreases in the input capacitance cause oscillations to diminish or cease, only a simple unidirectional trigger circuit is needed. The trigger circuit detects changes in the amplitude of the oscillations by sensing transitions in the AGC circuit.

The ability of the touch switch to sense decreases in the input capacitance allows it to detect several conditions important in alarm systems. First, the switch will be triggered when an object is removed from contact with the input conductor. The switch will also be triggered if the coupling between the oscillator signal ground and earth ground is broken. This is because removing the coupling to ground decreases the capacitive loading on the oscillator. The coupling between the signal ground and earth ground will be broken if the power plug is disconnected.

Radio frequency oscillators are by nature more sensitive to small changes in capacitance than are audio frequency oscillators, which usually have much larger values of capacitance in their feedback networks. Nevertheless, the present invention is very sensitive to small changes in capacitance even though it uses an audio frequency oscillator. The switch is typically triggered when a conductive object connected to the touch switch is touched by a human hand, even if the surface being touched is painted. This high sensitivity allows the switch to be remotely operated by touching or removing an object at the end of a long conductor. It also allows several objects to be connected to one touch switch.

The sensitivity of the touch switch is due to the linearity of the components in oscillator. To understand the need for linearity, suppose all of the oscillator components were perfectly linear and that the oscillator was oscillating at a constant amplitude. This stable condition requires a perfect match of positive and negative feedback. If the input capacitance is slightly increased, the positive feedback would be slightly decreased. Since the negative feedback would then exceed the positive feedback, the oscillations would rapidly decay away.

In actual practice, the nonlinearity of the oscillator components tends to decrease the amount of positive feedback as the amplitude of oscillation increases. This is primarily because the gain of the amplifier decreases as its output swing increases. Ceramic capacitors can also be significantly nonlinear. Now suppose we have an oscillator as previously described, but having typical nonlinear components. Increasing the input capacitance will again decrease the positive feedback. This time, however, as the oscillations begin to decay, the decreased amplitude of oscillations causes the positive feedback to increase. This will slow down the decay rate, and may even allow the oscillations to stabilize at some point. Thus, the sensitivity of the touch switch is decreased by typical component nonlinearities.

The AGC circuit enables the touch switch to automatically adjust itself to a wide range of ungrounded conductive objects which have a capacitance to ground less than some specified maximum level. The AGC circuit also eliminates the need for any manual adjustments during manufacturing to compensate for variations in component parameters.

The touch switch has a power-up circuit which ensures that the switch will be off when power is initially applied to the circuit.

The touch-switch alarm system of the present invention incorporates the touch switch of the present invention, or any other touch switch having substantially the same functions, and adds a few features that are necessary for implementing a practical self-contained alarm system. These features include: an arming switch, status indicators to show whether or not the alarm has been armed or triggered, an arming delay of several seconds after closing the arming switch during which the touch switch cannot be triggered, and an output delay which sets off the alarm a few seconds after touch switch has been triggered.

If the arming switch is mounted inside of a locked cabinet or safe, the arming delay will allow the system to be armed and the lock to be closed without triggering the touch switch. Conversely, after the touch switch is triggered, the output delay will allow a person open the lock by normal means and disarm the alarm.

If the arming switch is mounted on the outside of the protected object, the arming switch should be a lock switch. For added security, an electrically conductive lock switch should be used. The body of the lock switch should be electrically connected to the sensing terminal of the touch switch. This will cause the touch switch to be triggered if either the protected object or the lock switch is touched. The delay after the touch switch is armed will allow normal operation of the lock switch and removal of the key without triggering the touch switch. The output delay allows the arming switch to be turned off before an alarm is set off.

The touch switch alarm system can directly set off an alarm, or it can be incorporated as part of another alarm system.

BRIEF DESCRIPTION OF THE DRAWINGS

FIG. 5 that includes FIGS. 5A-5H contains a series of waveforms illustrating the operation of circuits described in FIG. 4.

DETAILED DESCRIPTION OF THE INVENTION

Figure 1:
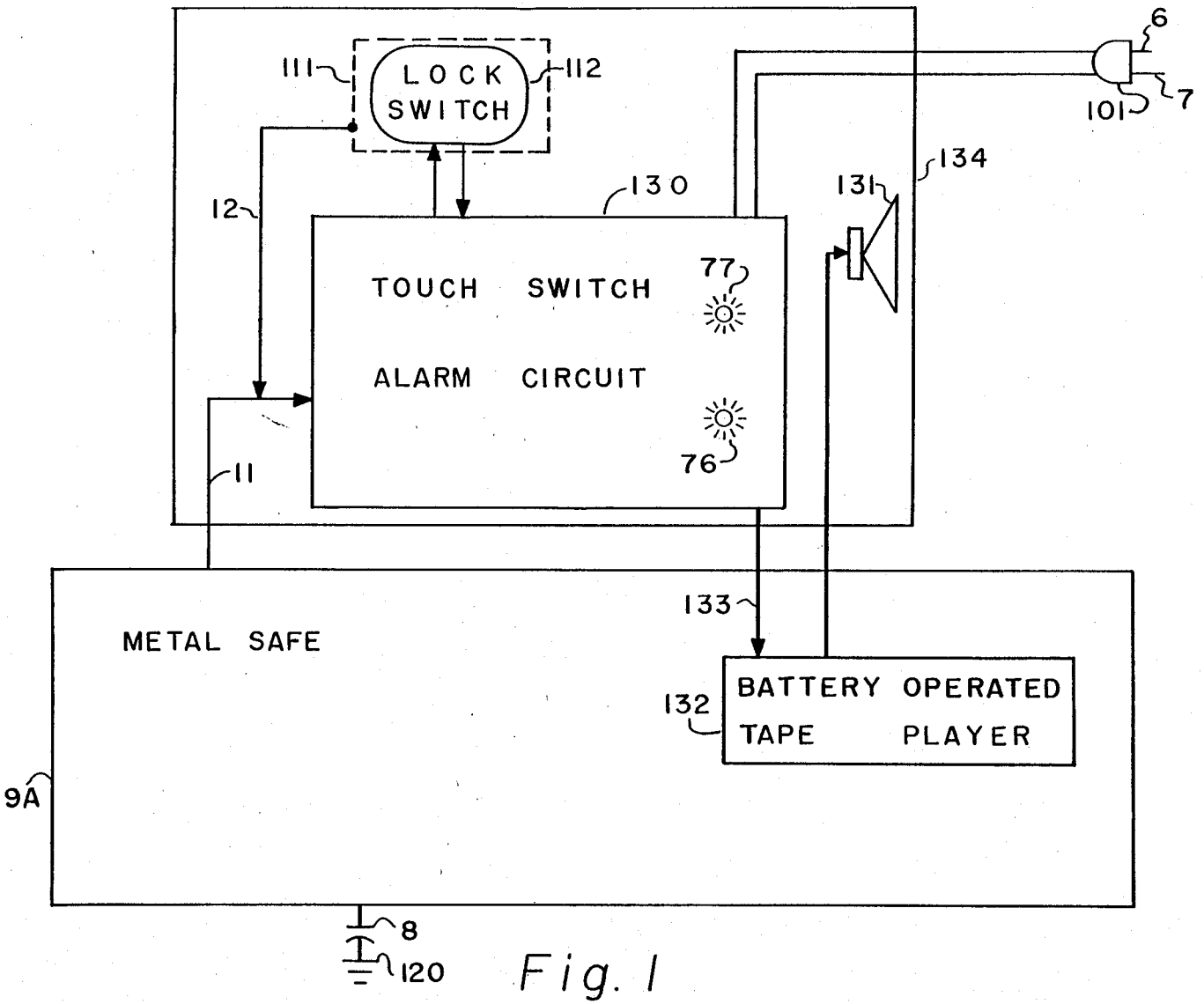
FIG. 1 is a block diagram of an alarm installation using the touch switch alarm system of the present invention.

Referring to FIG. 1, an installation of a preferred embodiment of the touch switch alarm system of the present invention includes a housing 134, a touch switch alarm circuit 130 connected by an input conductor 11 to an ungrounded metal safe 9A. The safe is a specific example of a protected conductive object 9 shown in subsequent figures. The alarm system is armed by an arming switch 112, which is a lock switch having a conductive body 111 connected by a conductor 12 to input conductor 11. Alarm circuit 130 comprises all of the touch switch alarm system of the present invention except arming switch 112, input conductor 11, and a power plug 101. Alarm circuit 130 includes status indicators (light emitting diodes (LEDs) 76 and 77), and has an output 133 that controls a battery-operated tape player 132, which drives a speaker 131.

Figure 2:
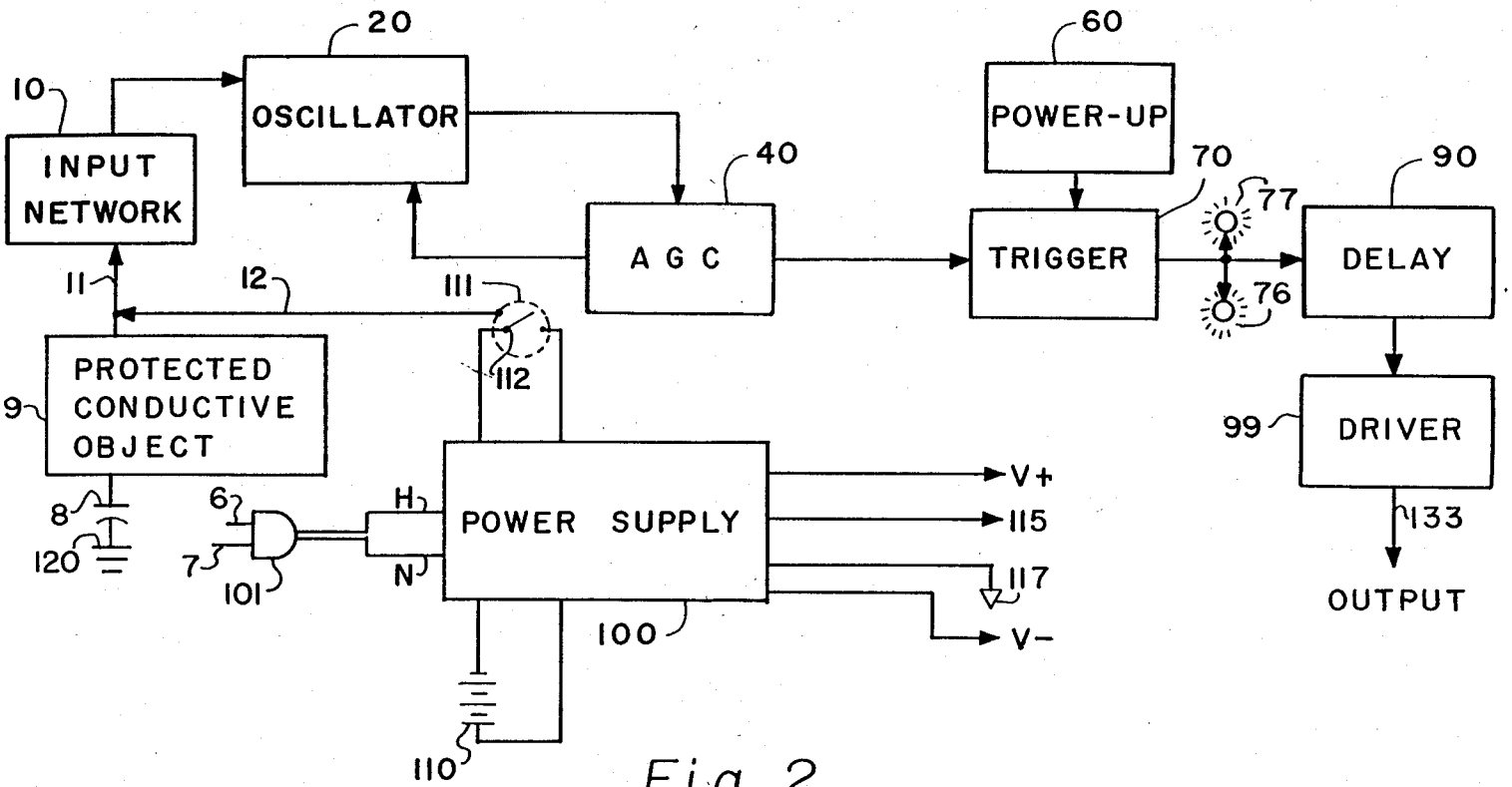
FIG. 2 is a more detailed block diagram of the touch switch alarm system circuits.

Referring to FIG. 2, the touch switch of the present invention comprises a power supply 100, an input network 10, an oscillator 20, an automatic gain control (AGC) circuit 40, a trigger circuit 70, and a power-up circuit 60. The alarm system of the present invention adds the following additional features: arming switch 112, two status indicators (LEDs 76 and 77), a delay circuit 90, and an optional driver circuit 99.

Figure 3:
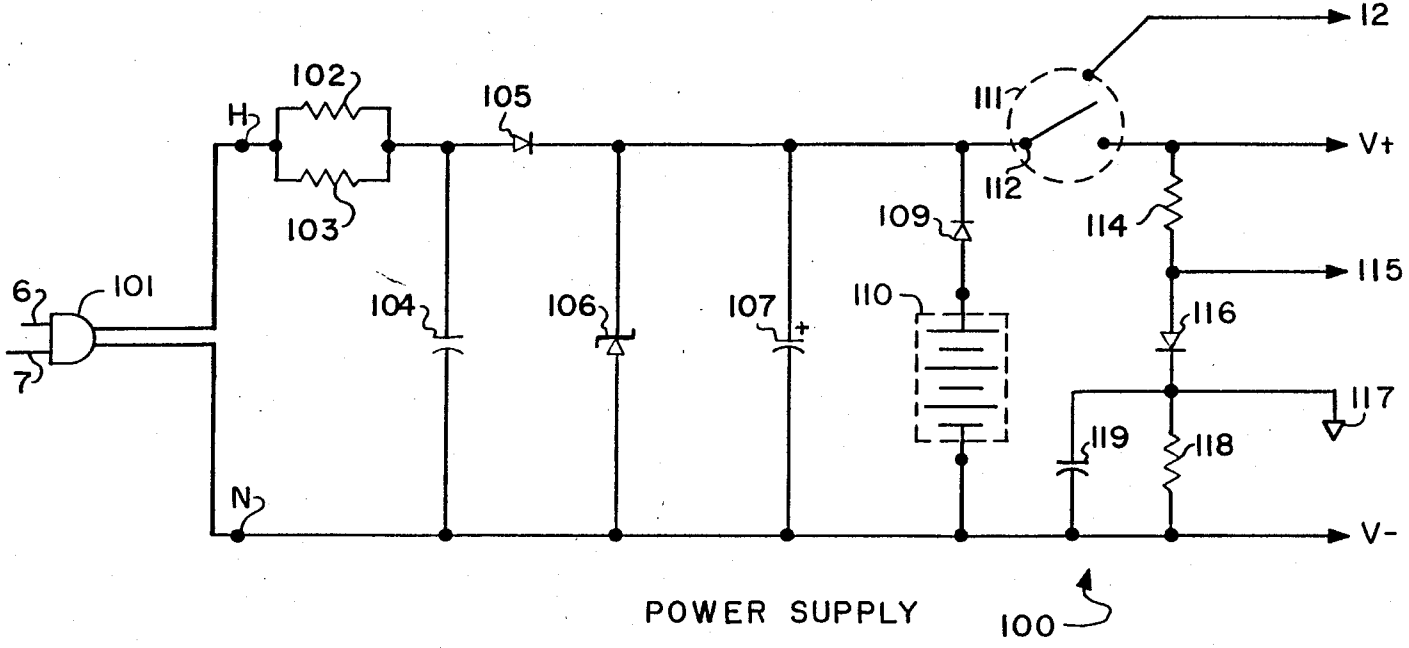
FIG. 3 is a schematic diagram for the power supply circuit of the system described in FIG. 2.

Referring to FIG. 3, power supply 100 normally receives power from the AC power lines through a polarized power plug 101, which has a neutral prong 7 and a hot prong 6. A back-up battery 110 supplies power to the circuit if AC power is lost. Power supply 100 has a neutral input terminal N connected to neutral prong 7, and a hot input terminal H connected to hot prong 6. Resistors 102 and 103 are connected to hot input H, and limit the current which flows through a rectifier diode 105. Resistors 102 and 103 also form a lowpass filter with a capacitor 104. The lowpass filter protects diode 105 by snubbing transient voltage spikes. A zener diode 106 regulates the supply voltage to a value slightly higher than the voltage of battery 110. A diode 109 prevents harmful reverse currents from flowing into battery 110. A capacitor 107 filters the rectified power line voltage. In order to prevent false triggering, capacitor 107 must be large enough so that the power supply output voltages will change slowly whenever AC power is lost or restored. Switch 112 allows power to flow to the alarm circuit when the switch is set to the "armed" (closed) position. A voltage divider is formed with resistors 114 and 118, creating a signal ground 117 midway between a positive output V+ and a negative output V−. A diode 116 provides a reference voltage source 115 at approximately 0.6 volts above signal ground 117. A capacitor 119 couples signal ground 117 to V−, which is connected to earth ground through neutral prong 7 of polarized plug 101 when the plug is inserted into a polarized AC outlet (not shown). To prevent false triggering, capacitor 119 should be small enough so that signal ground 117 will remain midway between V+ and V− when the power supply is shifting between AC power and the battery.

Figure 4:
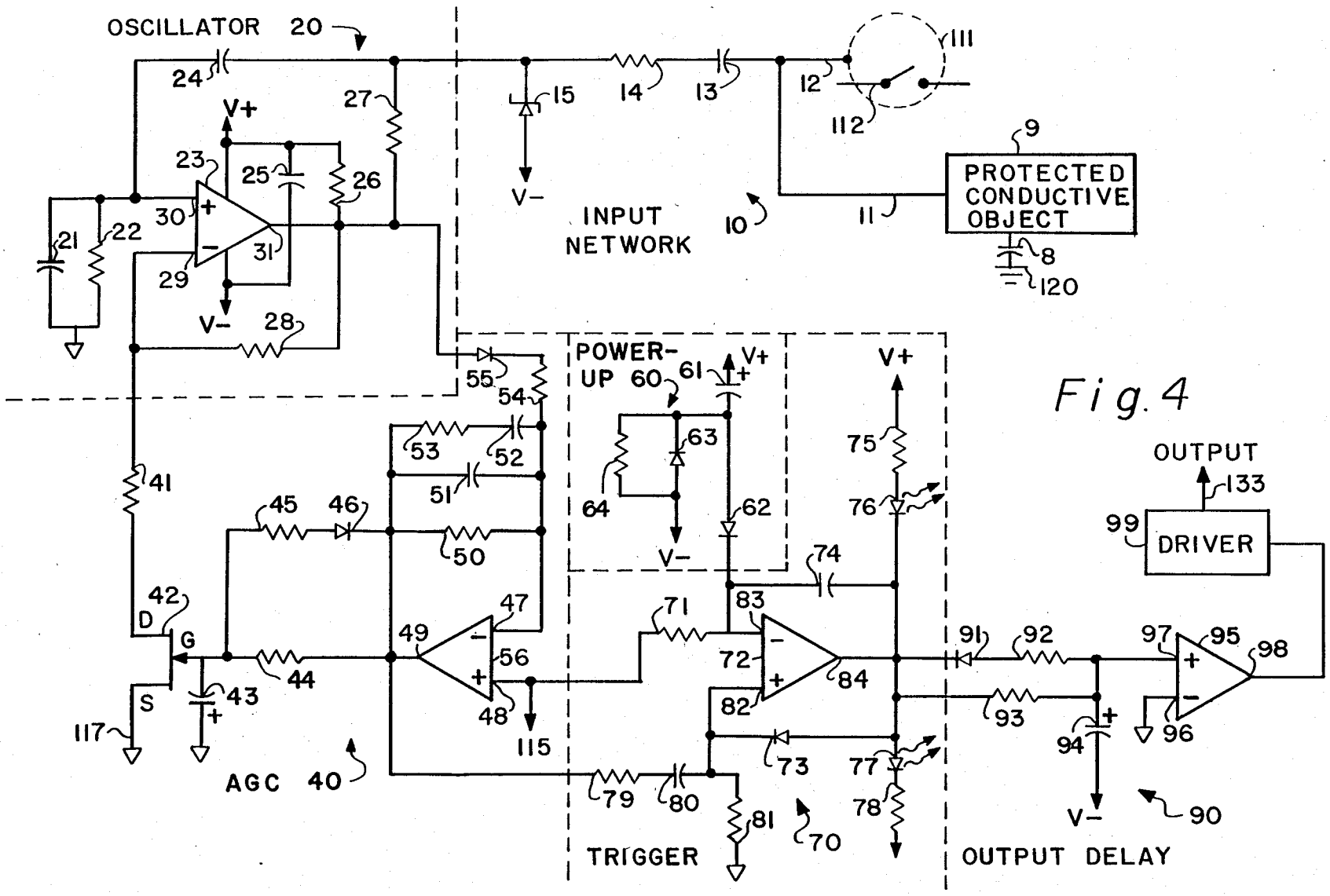
FIG. 4 is a schematic diagram for the rest of the circuits of the system described in FIG. 2.

Referring to FIG. 4, a single integrated circuit (IC) contains operational amplifiers (op-amps) 23, 56, 72, and 95. A bypass capacitor 25 is connected across the power supply terminals (not labeled) of the op-amp IC.

Oscillator 20 is a Wien-bridge sinusoidal oscillator using op-amp 23. Other sinusoidal RC oscillators such as phase shift oscillator could be used, but none of them are any simpler than a Wien-bridge oscillator. Op-amp 23 has an inverting input 29, a noninverting input 30, and an output 31. The Wien bridge has a reactive side formed by capacitors 21 and 24, and resistors 22 and 27. The bridge also has a resistive side formed by resistors 28 and 41, along with an n-channel junction field-effect transistor (JFET) 42. The JFET has a gate G, a drain D, and a source S, and is used as a voltage-controlled resistor. To maximize the linearity of the JFET, the drain-to-source voltage should be kept as small as possible. This is accomplished by making resistor 22 several times smaller than resistor 27. Resistor 41 also reduces the drain-to-source voltage. Oscillator 20 will produce a stable sinusoidal voltage at output 31 when the positive feedback at noninverting input 30 is precisely matched by the negative feedback at inverting input 29. The oscillator operates at a frequency where the reactive side of the bridge has zero phase shift.

The linearity of op-amp 23 is increased by a load resistor 26, which is small enough to draw more current than anything else connected to output 31. Due to its connection to V+ as opposed to signal ground, resistor 26 forces the op-amp to operate in a class A mode, which is inherently more linear than normal class B operation. Nonlinearity in capacitors 21 and 24 can reduce the sensitivity of the touch switch, so they should be low-loss film capacitors.

Input network 10 comprises input conductor 11, a capacitor 13, a resistor 14, and a zener diode 15. Capacitor 13 and resistor 27 form a highpass filter which greatly attenuates any low-frequency voltage induced on protected object 9 or input conductor 11 by nearby AC power lines. The highpass filter prevents low-frequency voltages from reaching noninverting input 30 of op-amp 23. Capacitor 13 should be small enough to prevent any current harmful to a human being from flowing out of the touch switch in the event that polarized power plug 101 is inserted into an incorrectly wired outlet. Resistor 14 and diode 15 protect the circuit from transient voltages that could get through the highpass filter.

Some of the current flowing through resistor 27 is diverted from the positive feedback loop of oscillator 20, and instead flows through input network 10. This current is drained to earth ground 120 through an input capacitance 8, thereby decreasing the amount of positive feedback. Input capacitance 8 represents the sum of all capacitances between input conductor 11 and earth ground 120, including the capacitances of protected object 9 and anything touching it. The drainage current loop is completed by neutral prong 7 of plug 101, which is connected to earth ground 120 when plug 101 is inserted into a polarized AC power outlet. A greater portion of the feedback signal is drained away if object 9 is touched by a person.

AGC circuit 40 compensates for changes in capacitance 8 by adjusting the resistance of JFET 42 to a value that restores balance to the Wien bridge. A diode 55 rectifies the output of oscillator 20. Op-amp 56 has an inverting input 47, a noninverting input 48, and an output 49. Op-amp 56 and a capacitor 51 integrate the difference between the half-wave rectified output of oscillator 20 and reference voltage 115. The DC gain of the integrator is limited by resistors 54 and 50. A resistor 44, and a capacitor 43 create a delay in the AGC loop. This delay has a time constant of several seconds, and can cause sustained low-frequency oscillations in the AGC circuit. A capacitor 52 and a resistor 53 prevent sustained oscillations in the AGC circuit, but allow damped oscillations. A resistor 45 and a diode 46 allow the AGC loop to quickly settle when power is first applied to the circuit.

Trigger circuit 70 uses op-amp 72 to sense positive transitions in the AGC voltage appearing at output 49 of op-amp 56. Op-amp 72 has an inverting input 83, a noninverting input 82, and an output 84. Noninverting input 82 is normally held to signal ground by a resistor 81, while a resistor 71 normally holds inverting input 83 about 0.6 volts above signal ground. This causes output 84 to be normally low. A capacitor 80 couples rapid changes in the AGC voltage to noninverting input 82. A sufficiently large and rapid positive transition in the AGC voltage will cause output 84 to become positive enough that a diode 76 will force op-amp 72 to latch with a positive output. A capacitor 74 prevents power line transients and static discharges from causing false triggering. A resistor 79 prevents subsequent changes in the AGC voltage from changing the state of trigger 70.

The series of waveforms in FIG. 5 illustrate the operation of AGC circuit 40 and trigger circuit 70. All voltage waveforms are with respect to V−. When input capacitance 8 suddenly increases (FIG. 5A), the oscillations of oscillator 20 quickly cease (FIG. 5B). The AGC voltage rises rapidly in response (FIG. 5C), but oscillator 20 remains momentarily inactive because capacitor 43 prevents the resistance of JFET 42 from rapidly changing. Meanwhile, the AGC voltage continues to rise, triggering trigger 70 (FIG. 5D). The JFET resistance eventually decreases to the point where oscillations resume. The oscillations overshoot their equilibrium value before stabilizing.

When capacitance 8 suddenly decreases (FIG. 5E), the oscillations suddenly increase (FIG. 5F). The AGC voltage now quickly drops. Again, capacitor 43 forces JFET 42 to respond slowly. Besides the delay caused by capacitor 42, the AGC loop has additional delays caused by the integrator and the rate at which the oscillations in oscillator 20 build up or decay in response to changes in the resistance of JFET 42. The net effect of these multiple delays is instability in the AGC loop. Thus, before finally settling, the oscillations cease and then overshoot the equilibrium value (FIG. 5F). The AGC voltage rises after oscillations have ceased (FIG. 5G), again causing trigger 70 to be triggered (FIG. 5H). Thus underdamped AGC circuit 40 enables unidirectional trigger circuit 70 to sense both increases and decreases in input capacitance 8.

Power-up circuit 60 has a capacitor 61 which is discharged when power is initially applied to the circuit or when switch 112 is initially set to the "armed" position. Capacitor 61 holds inverting input 82 of trigger 80 higher than noninverting input 83 through a diode 62 until a resistor 64 sufficiently charges the capacitor. This forces trigger output 84 to be in its low state when the touch switch first receives power. Immediately following this, power-up circuit 60 prevents the touch switch from being triggered for a time period that is determined by the values of capacitor 61 and resistors 64 and 71. A diode 63 discharges capacitor 61 when power is removed from the circuit or when switch 112 is set to the "off" position.

LED 76 glows when the alarm system is armed, and light-emitting diode (LED) 77 glows when the touch switch has been triggered. Resistors 75 and 78 limit the LED currents.

Output delay circuit 90 includes op-amp 95, which has an inverting input 96 connected to signal ground 117, a noninverting input 97, and an output 98. A capacitor 94 is connected between noninverting input 97 and V−. When trigger output 84 first goes high, capacitor 94 is charged through a resistor 93. When noninverting input 97 is at a higher voltage than inverting input 96, output 98 goes high. The length of the output delay is determined by the values of resistor 93 and capacitor 94. When trigger output 84 goes low, capacitor 94 is quickly discharged through a diode 91, and a resistor 92.

Output 98 can be used to directly control a low-current load such as a piezo buzzer. Larger loads can be controlled through an optional driver circuit 99, which can be any controlling device such as an opto-coupler, relay, or triac, which output 98 can operate. Driver circuit 99 can directly set off an alarm, or it can operate an input of another alarm system.

Having described and illustrated the invention, what is claimed is:

1. Touch switch means adapted to operate an electric circuit when an initial value of capacitance to earth ground of at least one ungrounded electrically conductive object connected to said touch switch means rapidly changes by a predetermined amount, said touch switch means comprising:

power supply means for supplying power to said touch switch means, said power supply means having a signal ground coupled to earth ground;

oscillator means comprising an amplifier, positive feedback means, and negative feedback means, said amplifier having a terminal connected to said signal ground, said amplifier having at least one input terminal and at least one output terminal, said positive feedback means being connected between an output terminal and an input terminal of said amplifier, said positive feedback means comprising resistive and capacitive means interconnected to form a phase shifting network which determines the frequency of oscillations of said oscillator means, said negative feedback means being connected between an output terminal and an input terminal of said amplifier so as to control the gain of said amplifier, thereby controlling the amplitude of said oscillations;

an input network comprising an input conductor adapted for connection to electrically conductive objects, a network output terminal, voltage limiting means for limiting the voltage at said network output terminal, and reactance means connected between said input conductor and said network output terminal, said network output terminal further connected to an intermediate point in said positive feedback means such that said reactance means forms a highpass filter for signals entering said oscillator means;

automatic gain control means for regulating the amplitude of oscillations of said oscillator means, said automatic gain control means having a delayed, underdamped response;

trigger means having an output capable of operating an electrical load when said trigger means detects a rapid change in the amplitude of oscillations of said oscillator;

power-up means for ensuring that said output of said trigger means is off when power is first applied to said touch switch means.

2. The touch switch means of claim 1, further including a lock switch for arming and disarming an alarm system incorporating said touch switch means, said lock switch having an electrically conductive body that is connected to said input conductor of said touch switch means, thereby allowing said touch switch means to protect said lock switch.

3. Touch switch means adapted to operate an electric circuit when an initial value of capacitance to earth ground of at least one ungrounded electrically conductive object connected to said touch switch means rapidly changes by a predetermined amount, said touch switch means comprising:

oscillator means comprising an amplifier, positive feedback means, and negative feedback means, said amplifier having a signal ground, and having at least one input terminal and at least one output terminal, said positive feedback means being connected between an output terminal and an input terminal of said amplifier, said positive feedback means comprising resistive and capacitive means interconnected to form a phase shifting network which determines the frequency of oscillations of said oscillator means, said negative feedback means being connected between an output terminal and an input terminal of said amplifier so as to control the gain of said amplifier, thereby controlling the amplitude of said oscillations;

an input network comprising an input conductor adapted for connection to electrically conductive objects, a network output terminal, voltage limiting means connected to said input network to limit the voltage at said network output terminal, and reactance means connected between said input conductor and said network output terminal, said network output terminal further connected to an intermediate point in said positive feedback means such that said reactance means forms a highpass filter for signals entering said oscillator means, and such that a portion of any signal transmitted through said positive feedback means will be drained off through said input network to earth ground through said capacitance to earth ground, thereby causing the amplitude of oscillations to decrease when said capacitance to ground is increased, and vice versa;

automatic gain control means connected to said negative feedback means and to an output terminal of said amplifier so as to regulate said amplitude of oscillations to a predetermined level which allows the oscillations to be sinusoidal, said automatic gain control means having a delayed, underdamped response when correcting variations in said amplitude of oscillations due to changes in said capacitance to earth ground;

unidirectional trigger means having an output capable of operating an electrical load when said unidirectional trigger means detects a rapid change in the oscillation amplitude of said oscillator by sensing a rapid change in a voltage within said automatic gain control means, the improvement being that a simple unidirectional trigger means may sense both increases and decreases in said capacitance to earth ground due to the underdamped response of said automatic gain control means;

power-up means for ensuring that said output of said trigger means is off when power is first applied to said touch switch;

power supply means having outputs terminals connected to said oscillator means, said automatic gain control means, and said trigger means, said power supply means having a signal ground coupled to earth ground and connected to said signal ground of said amplifier means.

4. The touch switch means of claim 3, further including a lock switch for arming and disarming an alarm system incorporating said touch switch means, said lock switch having an electrically conductive body that is connected to said input conductor of said touch switch means, thereby allowing said touch switch means to protect said lock switch.

* * * * *